US006283165B1

(12) United States Patent
Best

(10) Patent No.: US 6,283,165 B1
(45) Date of Patent: Sep. 4, 2001

(54) MACHINE FELT AND PROCESS FOR ITS PRODUCTION

(75) Inventor: Walter Best, Duren (DE)

(73) Assignee: Thomas Josef Heimbach Gesellschaft mit Beschrankter Haftung & Co., Duren (DE)

( * ) Notice: Subject to any disclaimer, the term of this patent is extended or adjusted under 35 U.S.C. 154(b) by 0 days.

(21) Appl. No.: 09/268,993

(22) Filed: Mar. 16, 1999

(30) Foreign Application Priority Data

Apr. 1, 1998 (DE) ..... 198 14 473

(51) Int. Cl.[7] ..... D03D 23/00; D03D 25/00

(52) U.S. Cl. ..... 139/383 A; 139/383 AA; 139/383 R; 139/408; 442/320; 28/100

(58) Field of Search ..... 442/320; 139/383 A, 139/425 A, 408, 413, 383 AA; 28/100

(56) References Cited

U.S. PATENT DOCUMENTS 4,781,967 11/1988 Legge et al. .

4,842,925 6/1989 Dufour et al. .

FOREIGN PATENT DOCUMENTS 26 22 206 12/1977 (DE) .
0 038 276 10/1981 (EP) .
0 261 488 3/1988 (EP) .
0 399 674 11/1990 (EP) .
WO 98/22651 5/1998 (WO) .

*Primary Examiner*—John J. Calvert
*Assistant Examiner*—Robert H. Muromoto, Jr.
(74) *Attorney, Agent, or Firm*—Young & Thompson

(57) ABSTRACT

The machine felt includes an insert having two sides and two ends, a layer of aligned longitudinal threads enclosing the two sides and two ends of the insert and coupling eyes formed by the layer of aligned longitudinal threads enclosing the two ends of the insert. The insert is enclosed by folding the layer of aligned longitudinal threads over the insert or by placing the insert within the layer of aligned longitudinal threads having a cylindrical configuration.

16 Claims, 2 Drawing Sheets

A
B 25
27
33
31
29
26
28
24
23
32
30

27
29
28
31
36
37
30
35
26
25
34

39
27
31
33
29
34
35
28
24
23
32
30
38
22

MACHINE FELT AND PROCESS FOR ITS PRODUCTION

FIELD OF THE INVENTION

The invention relates to a machine felt with at least two layers of bunches which have longitudinal threads and an insert located in between and with fiber layers which cover the outsides of the machine felt. It relates furthermore to a process for producing one such machine felt in which at least two longitudinal thread bunches are placed on top of one another with the interposition of an insert and at least one fiber layer is needled onto it.

BACKGROUND OF THE INVENTION

A machine felt of this type is described in U.S. Pat. No. 4,781,967. It has a modular structure, between two longitudinal thread bunches there being a transverse thread bunch or a fabric as the insert. On the outsides of and between the longitudinal thread bunches there are fiber layers. The individual modules are connected to one another by needling of the fiber layers.

Machine felts of the above described type are produced to be continuous. Aside from the fact that the length of these machine felts is limited, therefore they cannot be used everywhere, the mounting of the felt for example in the press part of a paper-making machine is difficult. Mounting of a machine felt is easier when it is present in an finite length and on its faces has coupling elements via which the ends of the machine felt can be coupled to one another in the machine (compare EP-A-0 261 488.

SUMMARY OF THE INVENTION

The object of the invention is to form a machine felt of the initially mentioned type such that it is available in finite form and its faces can be joined to one another.

This object is achieved as claimed in the invention in that the two layers of bunches which have longitudinal threads which proceed over both sides of the insert and border the insert on its faces with the formation of coupling eyes. The basic idea of the invention is therefore to guide the longitudinal threads of at least two layers of longitudinal thread bunches around the faces of the insert such that the two layers are formed by the same longitudinal threads. In doing so the longitudinal threads in the area of the faces of the insert form coupling eyes which can be overlapped for purposes of joining the faces and can be coupled in this position via an insert wire. Except for the insert wire no other special coupling elements are necessary. The unsteadiness caused by the coupling wire is hereby minimized. In addition, production of the machine felt becomes simple.

In one development of the invention it is provided that two layers of the longitudinal thread bunches at a time are formed by folding one thread bunch module produced in at least twice the length of the finished machine felt with inclusion of the insert. The ends of the longitudinal fibers abut one another preferably in the middle of the machine felt. This abutting is prevented when the longitudinal thread bunches form a continuous longitudinal thread bunch cylinder which includes the insert. In this case the longitudinal threads are formed to be continuous. They can be formed for example by helical winding of a longitudinal thread.

The basic structure of the machine felt as claimed in the invention can be varied in different ways. Thus it is possible for more than two layers of longitudinal thread bunches to be formed by providing several bunch units each consisting of two layers of longitudinal thread bunches with common longitudinal threads. This can be done for example by there being at least two bunch units on top of one another, and one or more inserts can be provided between the layers of the bunch units and also between the bunch units themselves. Alternatively the bunch units can be located nested within one another, here it also being possible to provide several inserts between the individual layers of the bunch units. To form the coupling eyes the longitudinal threads of only one bunch unit, but also those of all bunch units, can be used.

As claimed in the invention it is furthermore provided that one transverse thread bunch is applied on the outside to at least one longitudinal thread bunch.

To form the insert all known techniques are possible. Thus the insert can have one transverse thread bunch. It can thus be made in several layers and can additionally have one fiber layer. One longitudinal thread bunch can also be an element of the insert. Alternatively or in combination there can also be a fabric, knit and/or perforated film or also a thread lattice. The fiber layers should be needled to secure the longitudinal thread bunch.

A process for producing the above described machine felt is characterized as claimed in the invention by at least one longitudinal thread module being produced in at least twice the length of the finished machine felt and by the projecting sections of the longitudinal thread module being folded around the faces of the insert with the formation of coupling eyes by the longitudinal threads and being fixed. To facilitate insertion of a coupling insert wire, in the area of the coupling eyes disruptive material should be removed, for example by removing at least one face transverse thread of the insert. To the extent fiber material is present there, it: should be removed.

One alternative process is characterized in that a continuous longitudinal thread bunch cylinder and separately therefrom the insert are produced and that the insert is placed in the space surrounded by the longitudinal thread bunch cylinder. The longitudinal thread bunch cylinder can be continuously produced by helical winding of at least one longitudinal thread in the longitudinal direction and transversely thereto.

For stabilization of the longitudinal thread bunch needling of the fiber layers should be done. The fiber layers can be placed on one or both sides during or after producing the longitudinal thread bunch and attached. Fiber layers can also be attached to the insert on one or both sides and then also needled.

BRIEF DESCRIPTION OF THE DRAWINGS

In the drawing the invention is detailed using embodiments, the representation being schematic and not kept to scale.

DETAILED DESCRIPTION OF THE PREFERRED EMBODIMENT

Figures 1, 2, 3, 4:
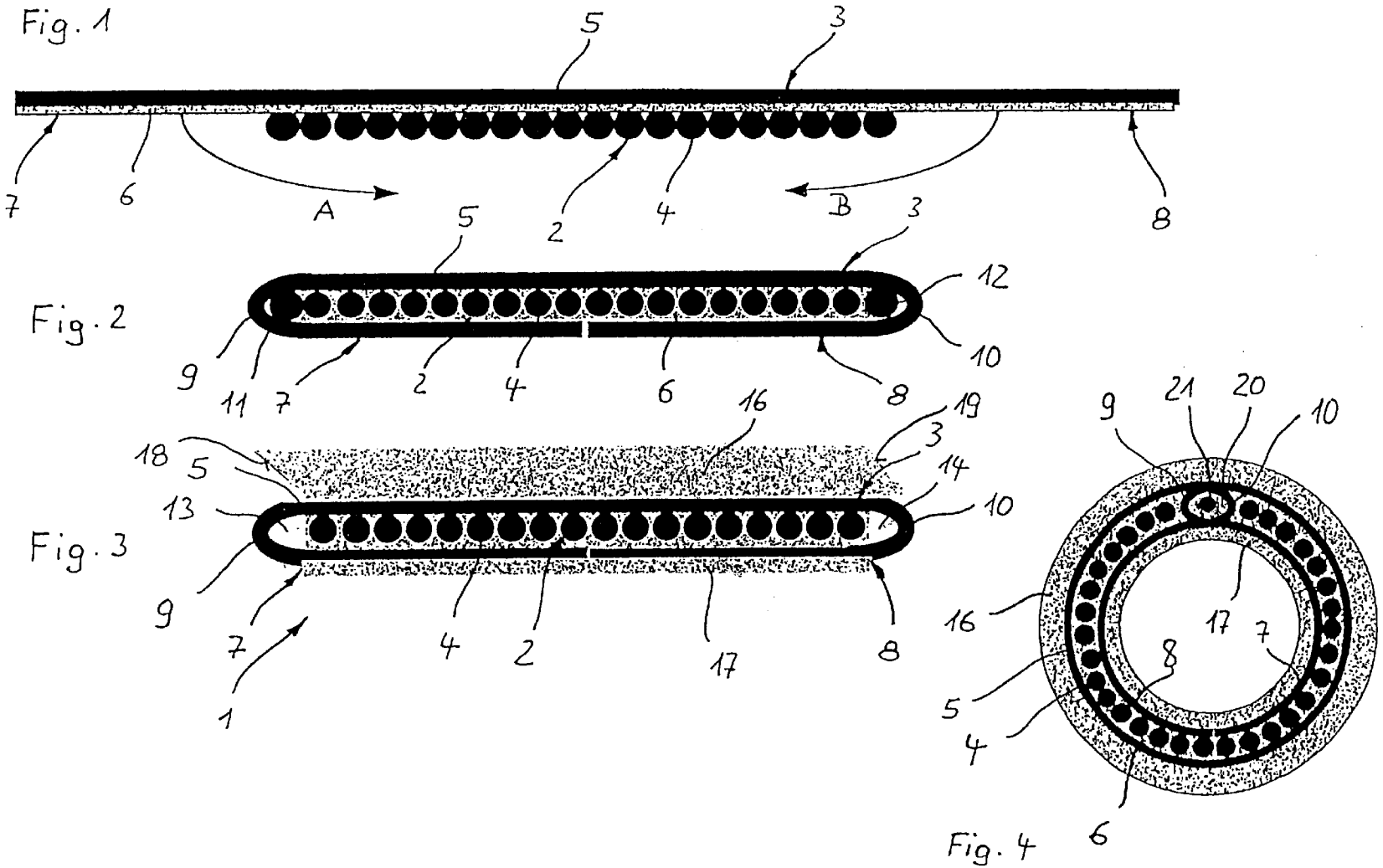
FIG. 1 shows a longitudinal thread module in the extended position with a transverse thread insert placed underneath in a side view.
FIG. 2 shows a combination of longitudinal thread At module and transverse thread insert after folding the projecting section onto the bottom of the transverse thread insert in a side view.
FIG. 3 shows a finished machine felt, produced from the combination as described in FIG. 2, in a side view.
FIG. 4 shows the machine felt as shown in FIG. 3 after joining the faces.

FIGS. 1 to 4 show in steps the production of a finite paper-making machine felt 1. First a transverse thread insert 2 and a longitudinal thread module 3 are produced separately. The transverse thread insert 2 consist of a host of transverse threads which are located next to one another and connected among one another, for example labelled 4, with a length which corresponds to the width of the longitudinal thread module 3. The longitudinal thread module 3 has a plurality of longitudinal threads 5 which are located next to one another perpendicularly to the plane of the drawing and which are attached to one another, and a fiber layer 6 is cemented to their bottom. The longitudinal thread module 3 in the extended position as shown in FIG. 1 is twice as long as the transverse thread insert 2. Center support of the longitudinal thread module 3 on the transverse thread insert 3 yields projecting sections 7, 8.

In the next production stage the sections 7, 8 are folded onto the bottom of the transverse thread insert 2 according to arrows A and B so that the faces of the sections 7, 8 almost abut one another. This situation is shown in FIG. 2. The preliminary product for the later paper-making machine felt 1 now has its length, the longitudinal threads 5 of the longitudinal thread module 3 passing around the faces of the transverse thread insert 2. To form coupling eyes 9, 10 there, the outside transverse threads 11, 12 of the transverse thread insert 2 and the fiber layer 6 there are removed. In this way a plurality of coupling eyes 9, 10 which are next to one another perpendicularly to the plane of the drawing and which include free insertion channels 13, 14 are formed.

In another production step, fiber layers 16, 17 are applied to the two outer sides of the longitudinal thread module 3, specifically on the top with a greater thickness than on the bottom. The fiber layers 16, 17 and the fiber layer 6 are then needled in a sewing machine, by which the transverse thread insert 2 and the folded sections 7, 8 are fixed among one another. The paper-making machine felt 1 is then finished.

Figures 5, 6, 7:
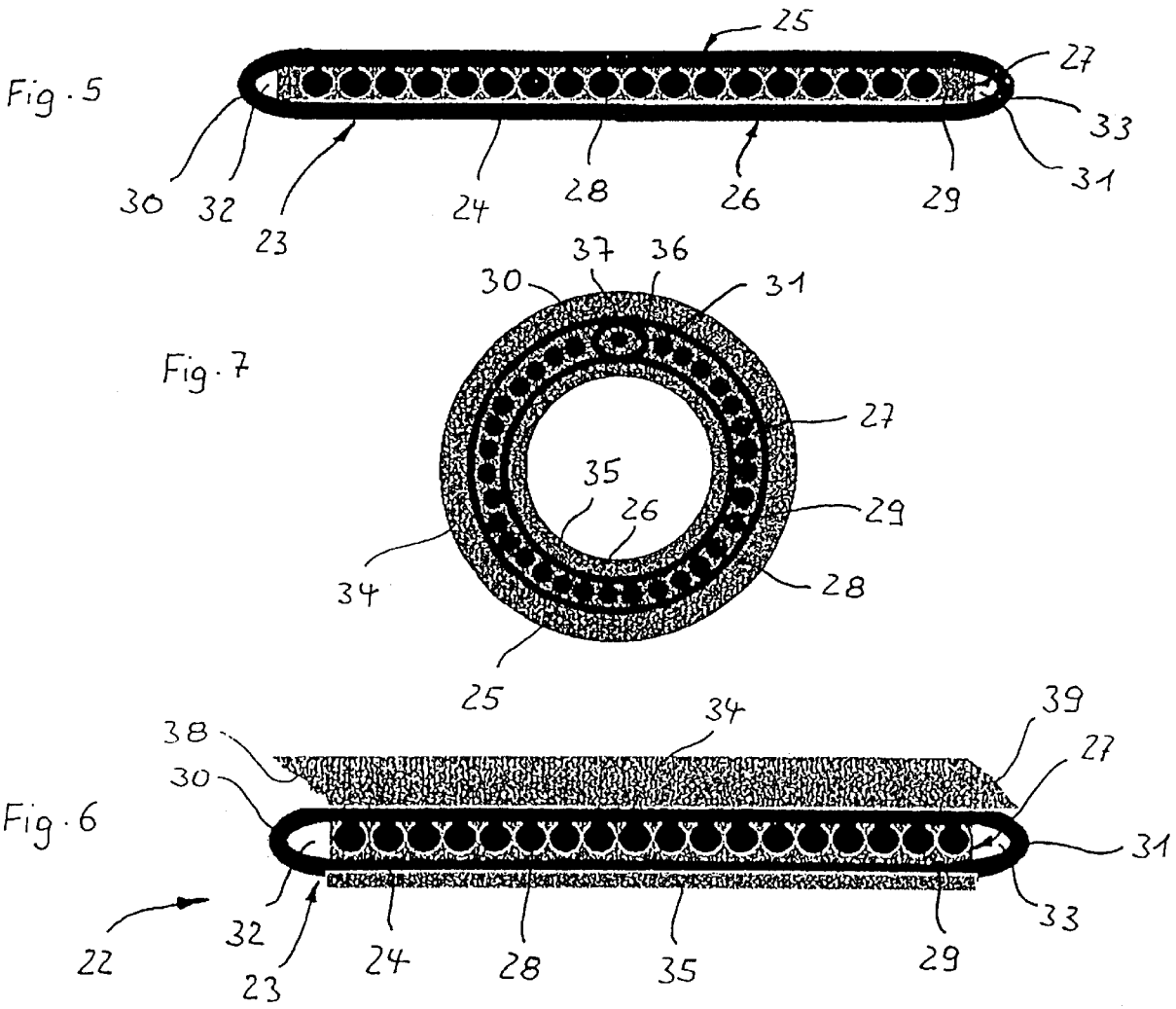
FIG. 5 shows a side view of a longitudinal thread bunch cylinder with transverse thread layer inserted therein.
FIG. 6 shows a side view of the machine felt produced from the unit as shown in FIG. 5.
FIG. 7 shows the machine felt as shown in FIG. 6 after coupling of its faces.

To join the faces the paper-making machine felt 1 is converted into the form shown in FIG. 4. In this case the coupling eyes 9, 10 overlap so that a coupling channel 20 is formed through which a coupling insert wire 21 is inserted. The latter connects the two faces. As a result of the bevels on the faces of the nonwoven 16, 17 they intersect so that the coupling eyes 9, 10 are covered on the outside by the nonwoven FIGS. 5 through 7 show the production of another paper-making machine felt 22. In this case first a longitudinal thread cylinder 23 is produced by helical winding of a longitudinal thread 24 via two spaced rollers. The individual windings of the longitudinal thread 24 are connected among one another. This yields a longitudinal thread top layer 25 and a longitudinal thread bottom layer 26.

A transverse thread insert 27 is pushed into the intermediate space between the longitudinal thread top layer 25 and the longitudinal thread bottom layer 26. It consists of a plurality of transverse threads which are connected among one another and which are located next to one another—for example labelled 28—and a fiber layer 29 needled on. The longitudinal extension of the transverse threads 28 corresponds to the width of the longitudinal thread cylinder 23 extending perpendicularly to the plane of the drawing. Compared to the length of the longitudinal thread cylinder 23 the transverse thread insert 27 is shortened such that on the faces of the longitudinal thread cylinder 23 coupling eyes 30, 31 arise which are formed by the longitudinal threads 24. The coupling eyes 30, 31 surround the free insertion channels 32, 33. In a subsequent process step fiber layers 34, 35 are placed on the outsides of the longitudinal thread top layer 25 and the longitudinal thread bottom layer 26 and are needled through among one another and with the fiber layer 29. Then the paper-making machine felt results.

To make this paper-making machine felt 22 continuous, the form shown in FIG. 7 is bent until the coupling eyes 30, 31 overlap and then include a coupling channel 36. Then a coupling insert wire 37 which produces the connection of the faces is inserted into the coupling channel. Here the faces 38, 39 of the fiber layer 34 are bevelled so that the overlap in the area of the coupling wire.

What is claimed is:

1. A machine felt comprising:

an insert having two sides and two ends;

a layer of aligned longitudinal threads enclosing the two sides and two ends of the insert; and coupling eyes formed by the layer of aligned longitudinal threads enclosing the two ends of the insert.

2. The machine felt as claimed in claim 1, further comprising fiber layers attached to the outside of the layer of aligned longitudinal threads.

3. The machine felt as claimed in claim 1, wherein the layer of aligned longitudinal threads forms a continuous cylindrical configuration.

4. The machine felt as claimed in claim 1, wherein the insert comprises a layer of transverse threads.

5. The machine felt as claimed in claim 1, further comprising a fiber layer attached to the insert.

6. The machine felt as claimed in claim 1, wherein the insert comprises a layer of longitudinal threads.

7. The machine felt as claimed in claim 1, wherein the insert comprises a fabric, knit, thread lattice or a perforated film.

8. A process for producing a machine felt comprising the steps of:

providing an insert having two sides and two ends;

providing a layer of aligned longitudinal threads, the layer having a length at least twice the length of the machine felt;

folding the layer of aligned longitudinal threads over the insert to enclose the two sides and two ends of the insert;

forming coupling eyes from the layer of aligned longitudinal threads enclosing the two ends of the insert; and fixing the coupling eyes together.

9. The process as claimed in claim 8, further comprising the step of attaching fiber layers to the layer of aligned longitudinal threads.

10. The process as claimed in claim 8, wherein the insert comprises a layer of transverse threads.

11. The process as claimed in claim 8, further comprising the step of attaching fiber layers to the insert.

12. A process for producing a machine felt comprising the steps of:

providing a layer of aligned longitudinal threads having a cylindrical configuration;

providing an insert having two sides and two ends;

placing the insert within the cylindrical configuration of the layer of aligned longitudinal threads to enclose the two sides and two ends of the insert with the layer of aligned longitudinal threads;

forming coupling eyes from the layer of aligned longitudinal threads enclosing the two ends of the insert; and fixing the coupling eyes together.

13. The process as claimed in claim 12, wherein the layer of aligned longitudinal threads is continuously produced by helically winding at least one longitudinal thread in a longitudinal direction and transversely thereto.

14. The process as claimed in claim 12, further comprising the step of attaching fiber layers to the layer of aligned longitudinal threads.

15. The process as claimed in claim 12, wherein the insert comprises a layer of transverse threads.

16. The process as claimed in claim 12, further comprising the step of attaching fiber layers to the insert.

* * * * *